US005222434A

United States Patent [19]

Smith et al.

[11] Patent Number: 5,222,434

[45] Date of Patent: Jun. 29, 1993

[54] SOFT ROLLERS FOR INK AND WATER FEEDING ROLLERS USED IN OFF-SET PRINTING PRESSES

[75] Inventors: Jeffrey D. Smith, Long Grove; Aldo Cardelli, Riverside, both of Ill.

[73] Assignee: Petco, Inc., Lake Forest, Ill.

[21] Appl. No.: 893,954

[22] Filed: Jun. 4, 1992

Related U.S. Application Data

[63] Continuation of Ser. No. 558,774, Jul. 26, 1990, abandoned.

[51] Int. Cl.[5] ..... B41F 1/46

[52] U.S. Cl. ..... 101/348; 101/349; 101/350; 492/35

[58] Field of Search ..... 101/348, 349, 350, 148, 101/367, 375, 205, 207, 208; 29/121.1, 121.4, 121.5, 121.6; 118/256, 258

[56] References Cited

U.S. PATENT DOCUMENTS

| | | | |
|---|---|---|---|
| 905,182 | 12/1908 | Hennessey | 126/367 |
| 1,079,339 | 11/1913 | Hennessey | 101/348 |
| 1,568,401 | 1/1926 | Griffith | 29/127 |
| 1,660,538 | 2/1928 | Whitney | 29/127 |
| 1,756,308 | 4/1930 | Schmidt | 101/349 |
| 2,199,228 | 4/1940 | Obenshain et al. | 29/121.1 |
| 2,309,585 | 1/1943 | Haddock | 29/121.1 |
| 2,369,814 | 2/1945 | Worthington | 101/350 |
| 3,056,164 | 10/1962 | Reichel et al. | 118/258 |
| 3,089,415 | 5/1963 | Grembecki et al. | 29/121.4 |
| 3,374,648 | 3/1968 | Maguire | 29/127 |
| 3,462,053 | 8/1969 | Behr | 29/127 |
| 3,613,575 | 10/1971 | Kantor | 101/350 |
| 3,750,250 | 8/1973 | Brown | 29/148.4 D |
| 4,143,092 | 3/1979 | Karmell | 260/31.2 N |
| 4,492,012 | 1/1985 | Pala et al. | 29/148.4 D |
| 4,566,162 | 1/1986 | Brands | 26/105 |
| 4,601,242 | 7/1986 | Fadner | 101/348 |
| 4,773,143 | 9/1988 | Okamura et al. | 29/128 |
| 5,016,530 | 5/1991 | Palmatier | 101/349 |

FOREIGN PATENT DOCUMENTS

| | | | |
|---|---|---|---|
| 2013321 | 10/1971 | Fed. Rep. of Germany | 101/349 |

*Primary Examiner*—Edgar S. Burr
*Assistant Examiner*—Lynn D. Hendrickson
*Attorney, Agent, or Firm*—James N. Videbeck

[57] ABSTRACT

A roller for moving one of ink and water through a printing press is disclosed as an elastomeric covering on a solid journal. The elastomeric covering includes spiral lands and valleys adjacent the lands having depths ranging from 0.002 to 0.004 inch for ducting water, and ranging from 0.002 to 0.015 inch for ducting ink. At valley depths of greater than 0.015, ink is carried solely on the lands for the purpose of lubricating the ductor system. One embodiment includes reversed spiral land and valley end segments that direct ink inwardly from the ends of the rollers to prevent ink buildup at those positions on a ductor roller.

12 Claims, 2 Drawing Sheets

SOFT ROLLERS FOR INK AND WATER FEEDING ROLLERS USED IN OFF-SET PRINTING PRESSES

This is a continuation of copending application Ser. No. 07/558,774, filed on Jul. 26, 1990, now abandoned.

BACKGROUND OF THE INVENTION

The invention relates generally to improvements in rollers used in off-set printing presses, and, more particularly, to improvements in the outer surface of soft elastomeric rollers for water dampening systems and ink train rollers providing improved direction and flow control for ink and water through their respective fluid feeding systems in offset printing presses.

Offset printing presses generally have separate product feeding systems for moving water, ink and paper to and through the printing press. Typically, these systems consist of a plurality of rollers which transfer and advance the necessary water, ink, and paper webs through the printing press. Ink train systems and water dampening systems move those respective fluids by passing same from one roller to an adjacent roller and so forth, with an initial roller picking up ink or water from a pan or fountain and passing same on to an adjacent roller. Typically, the ink or water feed system for a printing press includes alternating hard or metal rollers with soft or elastomeric material rollers positioned in between and in pinching communication with the adjacent metal rollers. In the case of water and ink feed systems, the respective fluid also helps to keep the series of rollers lubricated. Relevant patents to prior art inking rollers include U.S. Pat. Nos. 1,079,339; 905,182; and 4,601,242. Patents relating to elastomeric covered rollers for use in printing rolls include U.S. Pat. Nos. 3,750,250; 4,143,092; and 4,492,012.

An elastomeric covered rigid core roller for cross stretching printing webs is disclosed in U.S. Pat. No. 4,566,162.

While these patents disclose elastomeric covered rollers for use in printing presses, and disclose certain textured surfaces for such rollers for various purposes, a need has developed for an elastomeric covered rigid core roller for use in ink and water feeding systems of printing presses having lands and grooves of specified depths, widths and spiral directions capable of improving the direction and control of fluids travelling along such ink and water feed systems, respectively. Also, a need exists for rollers which aid in milling the ink in its travels along the ink train. Such a need exists especially in present day ink feed systems wherein adjustable fountain keys positioned adjacent the fountain rollers utilize a wiping action to control direction of ink flow across cylindrically surfaced rollers in the ink train. For example, the disclosure in old prior patent 905,182 at lines 30-37 indicates that the press in which that roller is to be used does not have adjustable fountain keys.

It is therefore an object of the present invention to provide improved elastomeric covered rollers for use in offset printing presses having multi-directional spiral lands and valleys positioned thereon for providing improved flow of water and ink through their respective water and ink feed systems.

SUMMARY OF THE INVENTION

The invention resides in a roller for use in a printing press fluid feeding system. The roller includes a journal centrally positioned on the roller and extending axially along its length, a generally elastomeric covering surrounding and secured on the journal, an outer surface of the elastomeric covering includes at least one spiral land extending generally circumferentially around the covering and extending axially outwardly of a central portion of the covering with a spiral valley being positioned adjacent the spiral land and extending therealong, the depth of the spiral valleys from the spiral lands being between about 0.002 inch and 0.015 inch for carrying ink in the valleys, and from about 0.002 to about 0.004 for carrying water in the valleys.

BRIEF DESCRIPTION OF THE DRAWINGS

The features of the present invention which are believed to be novel are set forth with particularity in the appended claims. This invention, together with further objects and advantages thereof, may best be understood by reference to the following detailed description taken in conjunction with the accompanying sheets of drawings, in the several figures of which like reference numerals identify like elements, and in which:

DETAILED DESCRIPTION OF THE PREFERRED EMBODIMENT

Figure 1:
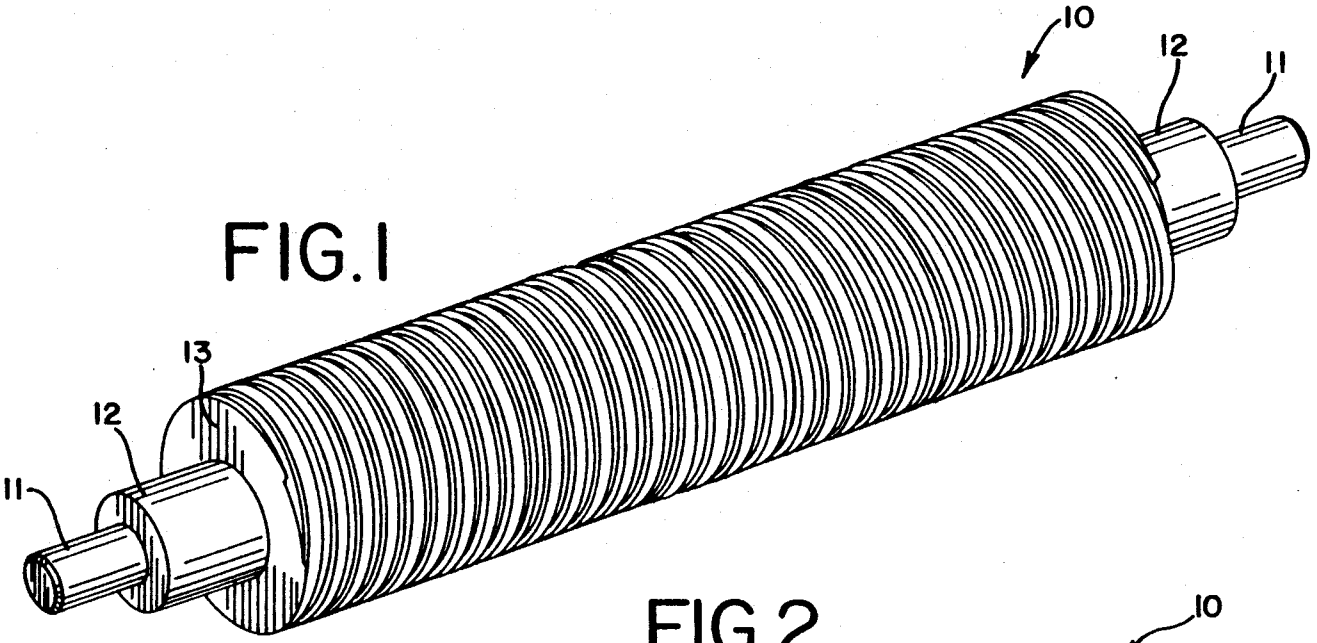
FIG. 1 is a perspective view of an elastomeric coated roller having an outer generally cylindrical surface having lands and valleys configured thereon in accordance with the present invention.

Referring to FIG. 1, an elastomeric roller 10, constructed generally in accordance with the present invention, and suitable for use in both an ink train system and a water dampening system, includes a metal central shaft or core 11, an enlarged raised cylindrical journal portion 12 which is not as long as shaft 11, and a generally cylindrical raised outer elastomeric covering, generally indicated at 13, which is not as long as journal 12. A preferred material for outer covering 13 is polyurethane, which may be cast and later machined to the proper contours. As is shown most clearly in FIG. 2, the outer surface of covering 13, in this embodiment includes a plurality of central annular lands 14—14 separated by a plurality of annular valleys 15—15 in alternating relation so as to define a central segment A of the outer surface of elastomeric coating 13. The outer covering 13 is shown is made of polyurethane, although rubber and other elastomeric materials, to a hardness equivalent of a material sold under the trademark NYLON may be utilized. Typical durometer hardness readings for preferred materials range from approximately 35-62, on the Shore A hardness test.

To the left of the annular lands of Segment A, is an elongate Segment B consisting of a left-handed spiral land 16 which spirals from the outer edge **15*a* of Segment A to the end of covering 13, and a left handed spiral valley 17 positioned immediately there adjacent also extending from the left edge 15*a* of Segment A to the end surface 13*a* of the covering 13. To the right side of Segment A is a right handed spiral Segment C consisting of a right handed spiral land 18 extending from the right edge 15*b*** of Segment A to the right end surface 13*b* of covering 13, and a right handed spiral valley 20 positioned immediately thereadjacent and also extending from the right edge 15*b* of Segment A to the right end surface 13*b* of covering 13. On a typical roller having a central raised portion 13 approximating eighteen inches in length, and two inches in diameter, a preferred size for the width of annular rings 14—14, left hand land 16 and right hand land 18 approximates 0.125 inch. A preferred width for the annular valleys 15—15, and left hand valley 17 and right hand valley 20 also approximates 0.125 inches.

It should be noted that the depth of the grooves may also be considered an effective depth at the line of contact between rollers in the feed system. A softer roller having a greater installed pressure against an adjacent roller may have an effective groove depth of less than its actual unmounted groove depth. A roller having a relatively harder elastomeric covering would not have much change of effective groove depth when in mounted position on a printing press.

Figure 2:
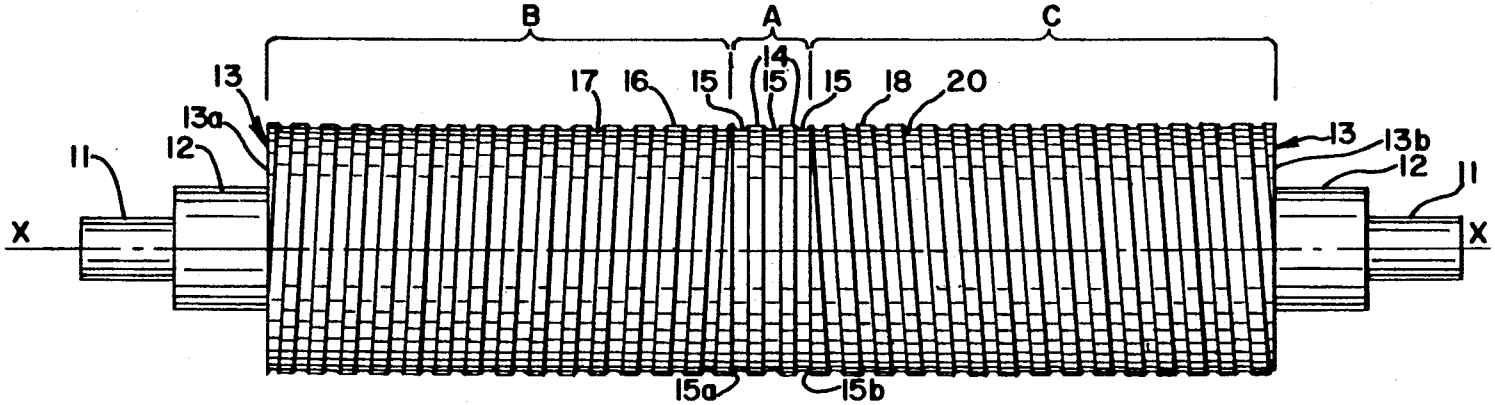
FIG. 2 is a front elevational view of the elastomeric covered roller shown in FIG. 1.
Figure 3:
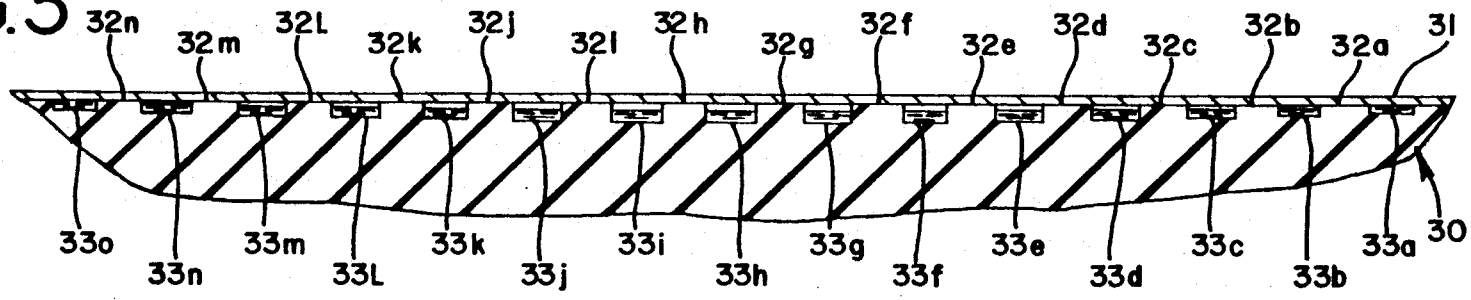
FIG. 3 is a fragmentary cross-sectional view taken substantially along line 3—3 of FIG. 2.

Referring to FIGS. 1, 2, 3, a preferred depth for the valleys on a roller for carrying water would be very shallow, approximating 0.002 inch, 0.003 inch or 0.004 inch. A preferred depth of the valleys on a roller for carrying ink in a portion of the valleys where the ink is to be transferred to another roller for eventual placement on a printing plate cylinder, would range from 0.002 inch to approximately 0.010 inch, with a most preferred range being from 0.003 inch to 0.007 inch. From valleys having a depth of about 0.007 inch to approximately 0.015 inch, ink may be carried, but the final image at the printing plate produced when ink train rollers with such depth valleys are used turns out to be somewhat degraded. At a roller valley depth of greater than 0.015 inch, ink mass in the valleys becomes large enough to be spit or thrown from the roller by centrifugal force. However, the use of valleys having a depth greater than 0.015 inch may be desirable on surface portions of a roller where it is desired that ink not be transferred down the ink feed system in sufficient quantities other than to lubricate the train of rollers, i.e., in portions of the roller where adjacent portions of a printing plate cylinder is not to have ink transferred thereto, as will be discussed in more detail below.

The spiral lands and valleys also help to direct the flow of ink sideways to desired positions on printing plate cylinders (not shown) and act to mill the ink for greater product uniformity. For example, with the roller 10 of FIG. 2 rolling in a direction with the lands and valleys moving spirally inwardly of the roller, the formation of the spirals as shown in FIG. 2 would keep the ink transferred on the roller from piling up on the ends of the roller, as is quite common in heretofore known ink train rollers. The addition of the annular lands 14 and valleys 15, providing that the valleys 15 were greater than 0.015 inches in depth and that fountain keys (not shown) at a similar axial position on an adjacent fountain roller were closed down would also keep ink from piling up in the center of the roller.

Further, when the spiral lands and valleys move the ink sideways on a roller, the grinding mill action enhances the uniformity of the ink being applied in the press and, therefore, produces a better quality product. While vibrating or oscillating rollers in the ink train normally move ink sideways in the ink train, the use of spiral lands and valleys increases the grinding or milling effect on ink pigment over that normally found on prior art cylindrical oscillating rollers. Radial lands 14 and valleys 15 have a zero deviation from 90° to the cylindrical axis X—X as shown in FIG. 2.

Spiral lands and valleys having an angle of from about 15° to about 45° from perpendicular to the X—X axis have a preferred combination of increased control of ink movement and increased milling of the ink. The lesser the angle the greater the control of the ink, and the greater the angle, the more the milling of the ink.

Additionally, if an offset printing press is set up to print material having two separate printed images positioned across the web with a blank space therebetween, the roller of FIG. 2 may be reversed in its mounting, so that ink is directed outwardly from the central portion of the roller where no printing is to take place on that axial position of an adjacent printing plate cylinder.

As is shown most clearly in FIG. 3, depending upon the purpose to be used by the portion of the roller 30 of the invention, the valleys, whether they be circumferential valleys, or spiral valleys, may be varied in depth along the same roller in order to perform specific differing tasks. Elastomeric roller 30 in FIG. 3 has an adjacent metal roller surface 31 positioned in line or thin surface (1 mm wide) contact with roller 30 to transfer or not to transfer ink from roller 30 to roller 31, as shall be described in greater detail below. As with the first embodiment of the present invention, the outer surface of the roller 30 includes a continuous spiral land which in cross section is identified as lands 32*a*–32*n*, each segment thereof being separated by a continuous spiral valley, which for clarity is shown as Segment 33*a*–33*o*.

While the lands 32*a*–32*n* and valleys 33*a*–33*o* of the embodiment shown in FIG. 3 are similar in width to the lands and valleys shown in FIG. 2, the depth of the valleys shown on the roller of FIG. 3 vary along the length of the roller. The valleys shown as Segments 33*a*–33*c* and 33*m*–33*o* vary between 0.002 and 0.007 inch deep. The valleys shown as 33*d*–33*l* are between 0.007 and 0.015 inch deep. The valley shown as 33*e* is greater than 0.015 of an inch deep with ink in it, and valleys 33*f*–33*k* have a depth greater than 0.015 and have no ink in them because individually adjustable fountain keys (not shown) mounted on a similar axial position of an adjacent fountain roller (not shown) have been closed down. Valleys 33*a*–33*d* as well as the lands 32*a*–32*d* adjacent to those valley segments and valleys 33*l*–33*o* and lands 32*k*–32*n* carry ink from roller 30 to roller 31, and provide for positioning ink on rollers downstream on the ink train system for producing images at that axial position on a printing plate cylinder (not shown). Lands 32*e*–32*j* carry ink on them in a quantity only sufficient to lubricate the roller, but not to produce an image downstream on the printing plate cylinder. The quantity of ink on lands 32*e*–32*j* is governed by the movement of the fountain keys on the fountain roller. Typical individually adjustable fountain keys approximate ½ inch in width and can be loosened or tightened against the fountain roller as desired and may be adjusted for each printing operation carried out by the printing press.

In FIG. 3, ink has been shown positioned in valley 33*e*, which has a depth greater than 0.015 inch for illustrational purposes only. In operation, the mass of ink in valleys having a depth greater than 0.015 inch is sufficient for centrifugal force to cause spitting of the ink, which is intolerable in the printing process. Therefore, when in operation, the fountain key adjacent land 32*c* and valley 33*e* should be closed down so ink is not carried in valley 33*e*.

Figure 4:
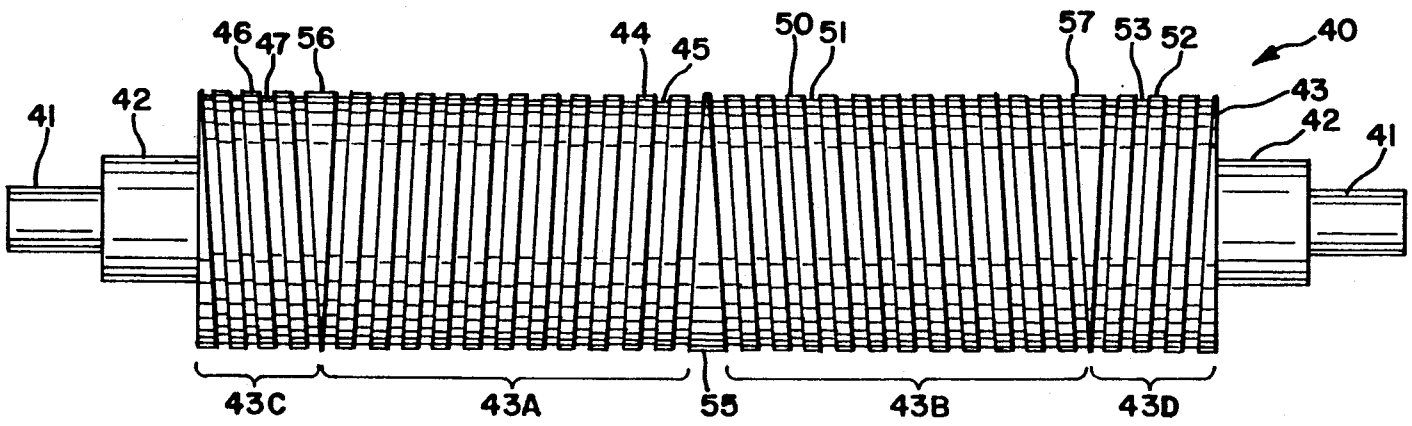
FIG. 4 is a front elevational view of a second embodiment of the present invention having right and left hand spiral surfaces and two distinct reverse spiral surface segments, one at each end of the roller.

Referring to FIG. 4, a third embodiment of the present invention is shown and described as roller 40, and it includes a central core 41 and a journal 42 having an elastomeric covering 43 on the outside thereof. The outer surface of elastomeric covering 43 is divided in this embodiment, into four sections, namely, 43A, 43B, 43C and 43D. On roller 40, left handed spiral land 44 and left handed spiral valley 45 make up the segment defined as surface 43A extending outward leftwardly from the center of roller 40. Outwardly of Segment 43 A is a right handed spiral segment 43C which is made up of a right handed land 46 and a right handed valley 47. To the right of the center of roller 40 is a right handed spiral segment 43B made up of a right handed spiral land 50 and a right handed spiral valley 51. Outwardly adjacent segment 43B is surface segment 43D which is a left handed spiral segment made up of left handed spiral land 52 and left handed spiral valley 53. In between each of these respective right and left handed segments is a crescent shaped transition surface denoted in between right and left handed segments 43A–43B as crescent 55 and in between left hands segment 43A and 43C as crescent 56, and in between right hand surface segment 43A and 43C as crescent 56, and in between right hand surface segment 43B and left handed surface segment 43D as crescent 57.

In operation, the roller 40 of FIG. 4 is utilized in a printing press wherein two split images are printed on a single web of paper. Ink is positioned on the central portion of roller 40 and spreads there outwardly to the left and right handed segments 43A, 43B, respectively to print images in the location of those segments downstream from the roller 40. The reverse spiraling end segments of roller surface 43C and 43D are positioned at the ends of the roller to prevent buildup of ink on the ends of the roller, which buildup is a common practice in heretofore known prior art rollers. In use, if the valleys 47 and 53 of the end segments of roller 40 were made deeper than 0.015 of an inch, the lands 46 and 52 would have only sufficient ink thereon to provide for lubrication of rollers in the ink train system.

While three embodiments of the present invention have been shown and described, it will be obvious to those skilled in the art that changes and modifications may be made without departing from the invention in it broader aspects. Therefore, the aim in the appended claims is to cover all such changes and modifications as far as within the true spirit and scope of the present invention.

The invention is claimed as follows:

1. A roller for use in a printing press fluid feeding system, said roller including:

a journal centrally positioned on said roller and extending axially along the length thereof; and a generally cylindrical elastomeric covering surrounding and secured on said journal;

said covering having an outer surface, a plurality of spiral lands formed as a part of and extending generally circumferentially around said outer surface and extending outwardly of a central portion of said covering, a spiral valley being positioned adjacent each said spiral land and extending therealong, all said spiral valleys being in parallel relationship to each other, an angle of said spiral land with a plane generally perpendicular to an axis of said roller being between about 15 degrees and about 45 degrees for providing improved direction control and milling of ink pigment on said fluid feeding system, and the depth of said spiral valleys from said spiral lands, respectively, being between about 0.002 inch and 0.015 inch.

2. A roller for use in a printing press fluid feeding system, said roller including:

a journal centrally positioned on said roller and extending axially along the length thereof; and a generally cylindrical elastomeric covering surrounding and secured on said journal;

said covering having an outer surface including first and second opposed end portions and a central portion therebetween, said covering including at least one left handed spiral land formed as a part of and extending generally circumferentially around said outer surface of said first end portion and extending axially outwardly of said central portion of said covering, a left handed spiral valley being positioned adjacent each said left handed spiral land on said first end portion and extending therealong and all said spiral valleys in said first end portion being in parallel relationship to each other, and said covering also having at least one right landed spiral land formed as a part of and extending generally circumferentially around said outer surface of said second end portion and extending axially outwardly of said central portion of said covering, a right handed spiral valley being positioned adjacent each said right handed spiral land and extending therealong, all said spiral valleys in said second end portion being in parallel relationship to each other, and the depth of said right handed and left handed spiral valleys from said right handed and left handed spiral lands, respectively, being between about 0.002 inch and 0.015 inch.

3. A roller for use in a printing press ink feeding system, said roller including:

a journal centrally positioned on said roller and extending axially along the length thereof;

a generally cylindrical elastomeric covering surrounding and secured on said journal, said covering having an outer surface, including a central portion, and first and second opposed end portions extending axially outwardly from said central portion, a plurality of left handed spiral lands formed as a part of and extending generally circumferentially around said outer surface of said first end portion and extending axially outwardly of said central portion of said covering, a left handed spiral valley being positioned adjacent each said left handed spiral land and extending therealong, all said spiral valleys in said first end portion being in parallel relationship to each other, a plurality of right handed spiral lands formed as a part of and extending generally circumferentially around said outer surface of said second end portion and extending axially outwardly of a central portion of said covering, a right handed spiral valley being positioned adjacent each said right handed spiral land and extending therealong, all said spiral valleys in said second end portion being in parallel relationship to each other the depth of said right handed and left handed spiral lands, respectively, being between about 0.002 inch and 0.015 inch for carrying ink in said valleys.

4. The roller as defined in claim 3 wherein said angles of said right hand spiral land and said le ft hand spiral land with a plane generally perpendicular to an axis of said roller are between about 15° and about 45° for providing improved fluid direction control and milling of ink pigment on said ink feeding system.

5. The roller as defined in claim 4, wherein at least one of said right and left hand spiral valley further include at least a portion of said valley having a depth greater than 0.015 inch for carrying ink solely on portions of said lands thereadjacent.

6. A roller for use in a printing press water feeding system, said roller including:

a journal centrally positioned on said roller and extending axially along the length thereof; and a generally cylindrical elastomeric covering surrounding and secured on said journal, said covering having a central portion and first and second end portions extending axially outwardly from aid central portion; and said covering having an outer surface including a plurality of left handed spiral lands formed as a part of and extending generally circumferentially around said outer surface of said first end portion and extending radially outwardly of said central portion of said covering, a left handed spiral valley being positioned adjacent each said left handed spiral land and extending therealong, and all said spiral valleys in said first end portion being in parallel relationship to each other, a plurality of right handed spiral lands formed as a part of and extending generally circumferentially around said outer surface of said second end portion and extending axially outwardly of said central portion of said covering, a right handed spiral valley being positioned adjacent each said right handed spiral land and extending therealong, and all said spiral valleys in said second end portion being in parallel relationship to each other, the depth of said right handed and left handed spiral valleys from said right handed and left handed spiral lands being between about 0.002 inch and about 0.004 inch for carrying water in said valleys in a direction outwardly with respect to said central portion.

7. A roller for use in a printing press ink feeding system for being positioned downstream from a fountain roller having individually adjustable fountain keys mounted in connection therewith, said roller including:

a journal centrally positioned on said roller and extending axially along the length thereof; and a generally cylindrical elastomeric covering surrounding and secured on said journal and having first and second end portions extending axially outwardly of a center of said cylindrical covering, said covering having an outer surface including a first left handed spiral land formed as a part of and extending generally circumferentially around said outer surface of said first end portion and extending axially outwardly of said central portion of said covering, a left handed spiral valley being positioned adjacent each said left handed spiral land and extending therealong, all said spiral valleys in aid first end portion being in parallel relationship to each other, a first right handed spiral land formed as a part of and extending generally circumferentially around said outer surface of said second end portion and extending axially outwardly of said central portion of said covering, a right handed spiral valley being positioned adjacent each said right handed spiral land and extending therealong, all said spiral valleys in said second end portion being in parallel relationship to each other, and first and second opposing ends of said elastomeric covering, said first opposing end adjacent said first left handed spiral land and said left handed spiral valley and said first opposing end including a second right hand spiral land formed as a part of and extending generally circumferentially around said outer surface and extending axially outwardly of said first left handed spiral land and said left handed spiral valley, a second right handed spiral valley being positioned adjacent said second right handed spiral land and extending therealong for directing ink inwardly of said first opposing end, said second opposing end adjacent said first right handed spiral land and said right handed spiral valley and said second opposing end including a second left hand spiral land formed as a part of and extending generally circumferentially around said outer surface and extending axially outwardly of said first right handed spiral land and said right handed spiral valley, a second left handed spiral alley positioned adjacent said second right handed spiral land and extending therealong for directing ink inwardly of said second opposing ends to prevent ink build-up at said first and second opposing ends during use of said roller.

8. A roller for use in a printing press ink feeding system for being positioned downstream from a fountain roller having individually adjustable fountain keys mounted in connection therewith, said roller including a journal centrally positioned on said roller and extending axially along the length thereof; and a generally cylindrical elastomeric covering surrounding and secured on said journal said covering having a central portion and first and second end portions, an outer surface of said elastomeric covering including at least one left handed spiral land extending generally circumferentially around said first end portion of said covering and extending axially outwardly of said central portion of said covering, a left handed spiral valley being positioned adjacent said left hand spiral land and extending therealong, at least one right handed spiral land extending generally circumferentially around said second end portion of said covering and extending axially outwardly of said central portion of said covering, a right handed spiral valley being positioned adjacent said right hand spiral land and extending therealong, and a plurality of annular lands and adjacent annular valleys forming a ring segment in said central portion between said one right handed spiral land and said one left handed spiral land for preventing ink buildup therebetween during use of said roller.

9. The roller as defined in claim 8 wherein at least portions of said annular valleys have a depth greater than about 0.015 inch.

10. A roller for use in a printing press fluid feeding system, said roller including:

a journal centrally positioned on said roller and extending axially along the length thereof; and a generally cylindrical elastomeric covering surrounding and secured on said journal;

said covering having an outer surface, a central segment, and first and second opposing outer end segments, each of said first and second outer end segments covering no more than one quarter of the axial length of said covering, said first outer end segment including at least one left handed spiral land formed as a part of and extending generally circumferentially around said outer surface and extending axially outwardly of a central segment of said covering, a left handed spiral valley being positioned adjacent each said left handed spiral land and extending therealong, all said spiral valleys in said first outer end segment being in parallel relationship to each other, and said second outer end segment including at least one right handed spiral land formed as a part of and extending generally circumferentially around said outer surface and extending axially outwardly of a central portion of said covering, a right handed spiral valley being positioned adjacent each said right handed spiral land and extending therealong, and all said spiral valleys in said second outer end segment being in parallel relationship to each other.

11. A roller in accordance with claim 10 wherein further comprising:

land and valley means in said central segment for transferring one of ink and water to an adjacent roller.

12. A roller in accordance with claim 11 wherein claim 11 wherein the depth of said right handed and left handed spiral valleys from said right handed and left handed spiral lands, respectively, is between 0.002 inch and 0.015 inch.

* * * * *